US006691730B1

(12) United States Patent
Chen

(10) Patent No.: US 6,691,730 B1
(45) Date of Patent: Feb. 17, 2004

(54) INFLATABLE PAD WITH A BUILT-IN PUMP

(76) Inventor: Chin-Tang Chen, 5FL, No 26, Jinhua St., Daan Chiu, Taipei (TW)

( * ) Notice: Subject to any disclaimer, the term of this patent is extended or adjusted under 35 U.S.C. 154(b) by 0 days.

(21) Appl. No.: 10/214,572

(22) Filed: Aug. 9, 2002

(51) Int. Cl.[7] ..... A63B 41/00

(52) U.S. Cl. ..... 137/223; 137/224; 141/114; 417/435; 417/472

(58) Field of Search ..... 137/223–225; 141/67, 114, 313, 316, 317; 417/305, 435, 454, 455, 472

(56) References Cited

U.S. PATENT DOCUMENTS 2,697,229 A * 12/1954 Krueger ..... 450/38
4,991,317 A * 2/1991 Lakic ..... 36/44
5,098,095 A * 3/1992 Weiss ..... 473/593
5,158,767 A * 10/1992 Cohen et al. ..... 36/88
5,238,244 A * 8/1993 Cotter et al. ..... 473/593
5,406,661 A * 4/1995 Pekar ..... 5/655.3
5,515,622 A * 5/1996 Lee ..... 36/3 R
5,697,974 A * 12/1997 Wang ..... 623/7
5,839,139 A * 11/1998 Fink ..... 5/648
6,019,122 A * 2/2000 Chen ..... 137/223
2003/0014819 A1 * 1/2003 Richardson ..... 5/644
2003/0024051 A2 * 2/2003 Wilkinson ..... 5/713
2003/0032507 A1 * 2/2003 Lacroix et al. ..... 473/593

* cited by examiner

*Primary Examiner*—J. Casimer Jacyna
(74) *Attorney, Agent, or Firm*—Bacon & Thomas

(57) ABSTRACT

The invention is an inflatable pad with a built-in pump, including an inflation unit with a laminated fringed chamber and an interior air pump assembly with an inflation and deflation channel. The pump chamber has two pieces of unidirectional membrane tubing in a reverse loop. One tubing is a channel between the pump chamber and the inflation chamber. The other tubing is installed inside the pump chamber so that one end connects to the pump chamber and the other to a piece of round tubing on the chamber edge. The round tubing connects to the laminated edge of the inflation chamber and has an insertable hollow bolt so that an inflation access is formed. On the round tubing surface ther is a vent hole. When the bolt is removed from the tubing, a deflation channel is formed.

2 Claims, 6 Drawing Sheets

(A)

(B)

(C)

(A)

(B)

(A)

(B)

INFLATABLE PAD WITH A BUILT-IN PUMP

FIELD OF THE INVENTION

The structural design for the inflatable pad in the present invention especially means a new type of air pad structure with built-in pump for inflation and deflation.

BACKGROUND OF THE INVENTION

Traditional inflatable pads have a wide range of applications, such as use inside bra cup for breast push-up and breast enhancement or for the coziness of pillow or in shoe sole for reducing impact to foot and providing cushion and resilience. They are well accepted by the industry and the consumers. However, such inflatable pads usually are in a fixed size filled with certain amount of air. The pads properly inflated and sealed would be combined with other products. Such single-size pads can not provide versatility to satisfy the needs of the general consumers.

Therefore, the industry developed an adjustable inflatable pad. As shown in FIG. 1A and FIG. 2A, the general inflatable pad is added with a valve that can allow air to flow in and out. Through either mouth blowing, a hand pump (as in FIGS. 1B and C) or hand pressing (as in FIG. 2B), the amount of air to be filled can be adjusted to meet the demand. Although such a design can solve the problem with lack of applicability for the traditional fixed-size inflatable pads and possess both versatility and flexibility, the inflation method of mouth blowing is not esthetic and has hygiene concerns. Besides, carrying an additional mini pump not only causes inconvenience to users but also possibility to lose it, which further gives troubles to users.

Nevertheless, the industry is consistently seeking improvement and has come up with various types of design that combines a small pump or an inflation device with the inflation pad, such as the patents of No. 451,623 and No. 465,280 in Taiwan. In general, such inflation pad has its inflation device of complicated structure and design. As a result, not only operation faces some difficulties, but also inflation/deflation adjustment seems very difficult. It is not considered as a well-designed inflation pad structure.

In view of this, the inventor for the present invention, with aim at the shortcomings of the existing inflation pads and dedication to serving the general public, further provides an alternative that can solve the existing problems and replace the existing inflation pads in the market.

SUMMARY OF THE INVENTION

The primary objective for the present invention is to provide an inflation pad with a built-in pump. Depending on user's needs, inflation level can be adjusted by using a hollow bolt for valve opening and closure. During inflation, the hollow bolt is in place to seal a vent hole and secured by user's hand pressing. For deflation, first the hollow bolt is removed to open the vent hole, and then users press the inflation chamber by hands. Such design has a desired inflation/deflation access so there are no concerns about esthetic feeling, hygiene and convenience during operation. Besides, the inflation pad structure is simplified and light-weight for operational convenience.

Another objective for the present invention is to provide an inflation pad with a built-in pump so its structural design can be widely adopted in different products, such as bras, pillows and shoes. The practical applicability for such products will thus be increased with high value for industrial use.

According to the above-mentioned objectives, the present invention is to provide an inflation pad with a built-in pump, which mainly comprises inflation unit and inflation pump assembly. The inflation unit is made of air-impermeable tough film that is sealed at peripheral by high frequency process and forms an inflation chamber with laminated fringe. The inflation pump assembly is installed inside the inflation unit and composed of a protuberant pump chamber and an inflation/deflation channel. The inflation pump is made of highly pressure resistant elastomer so it will not be contracted under pressure. On one side of the pump chamber, there are two pieces of unidirectional membrane tubing, A and B, in a reverse loop. The membrane tubing B is provided as a channel between the pump chamber and the inflation chamber. The membrane tubing A is installed inside the pump chamber so that one end connects to the pump chamber and the other end at the chamber edge connects to a piece of round tubing. The round tubing connects to the laminated edge of the inflation chamber and has an insertable hollow bolt so that an inflation access is formed. On the proper place of the round tubing surface, there is a vent hole. When the hollow bolt is removed from the round tubing, a deflation channel is formed. Furthermore, such design allows free adjustment of inflation level and fast inflation/deflation for the pads without the need of additional auxiliary equipment.

The following is to give detailed description of the technical features and advantages for the present invention through figures and examples.

DETAILED DESCRIPTION OF THE PREFERRED EMBODIMENT

Figure 1:
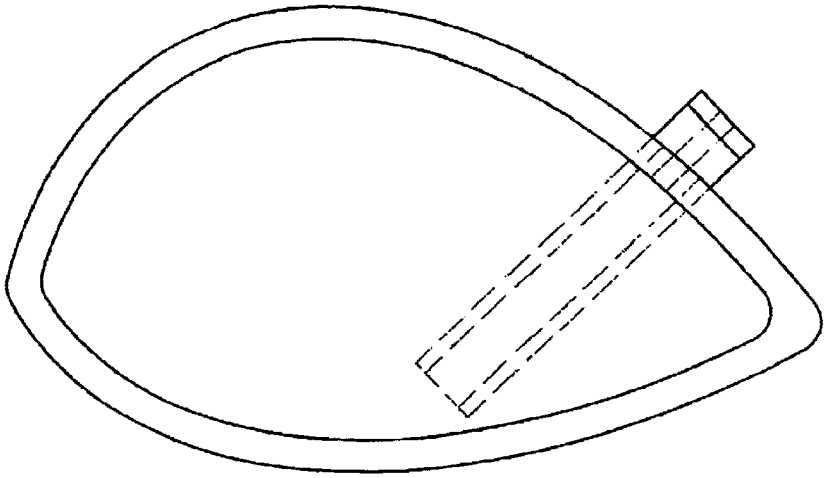
Fig 1 Prior Art
FIG. 1A is structure for a traditional inflation pad.
FIG. 1B is an illustration for a traditional inflation pad in inflation state 1.
FIG. 1C is an illustration for another traditional inflation pad in inflation state (2).
Figure 1:
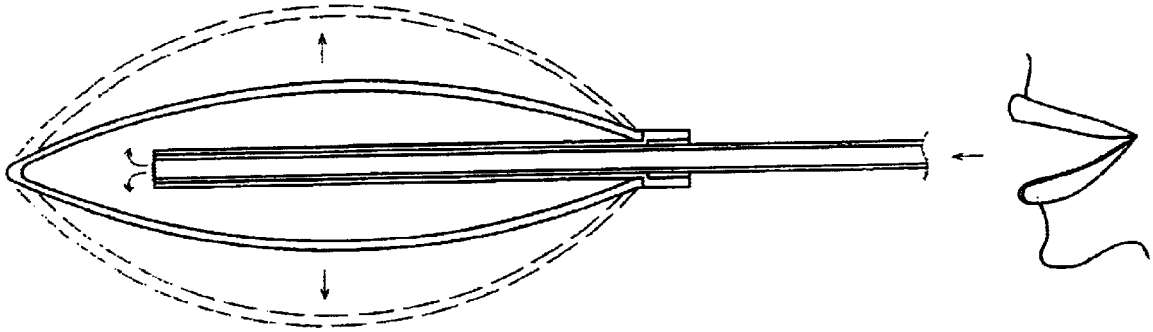
Fig 1 Prior Art
Figure 1:
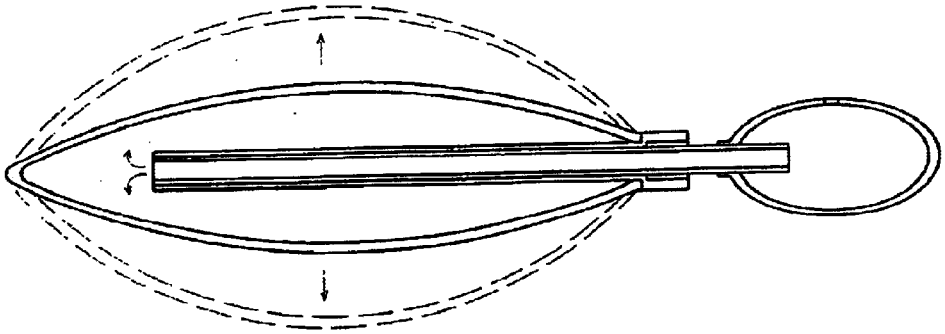
Fig 1 Prior Art
Figure 2:
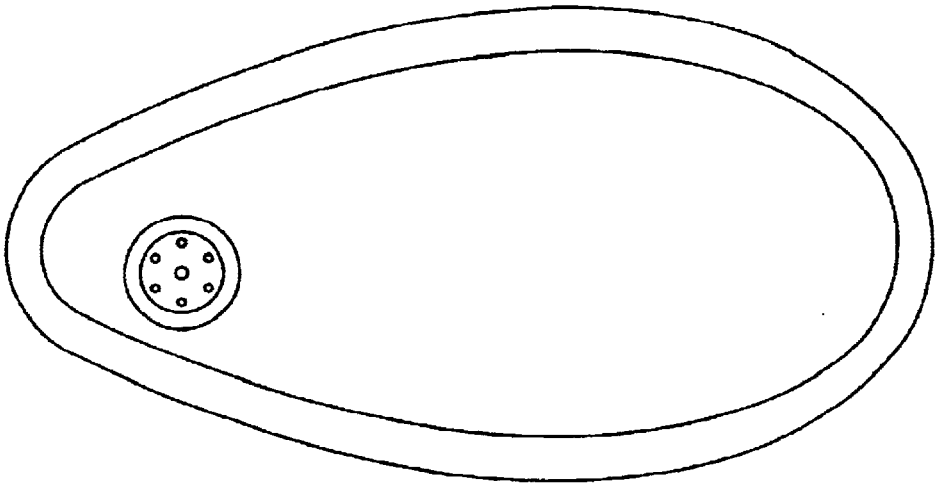
Fig 2 Prior Art
FIG. 2A is an illustration for structure for a traditional inflation pad.
FIG. 2B is an illustration for another traditional inflation pad in inflation status.
Figure 2:
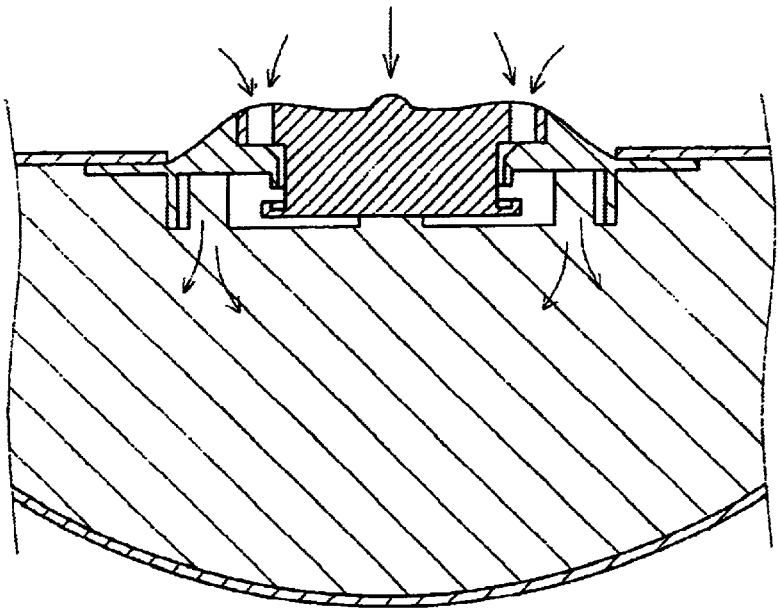
Fig 2 Prior Art
Figure 3:
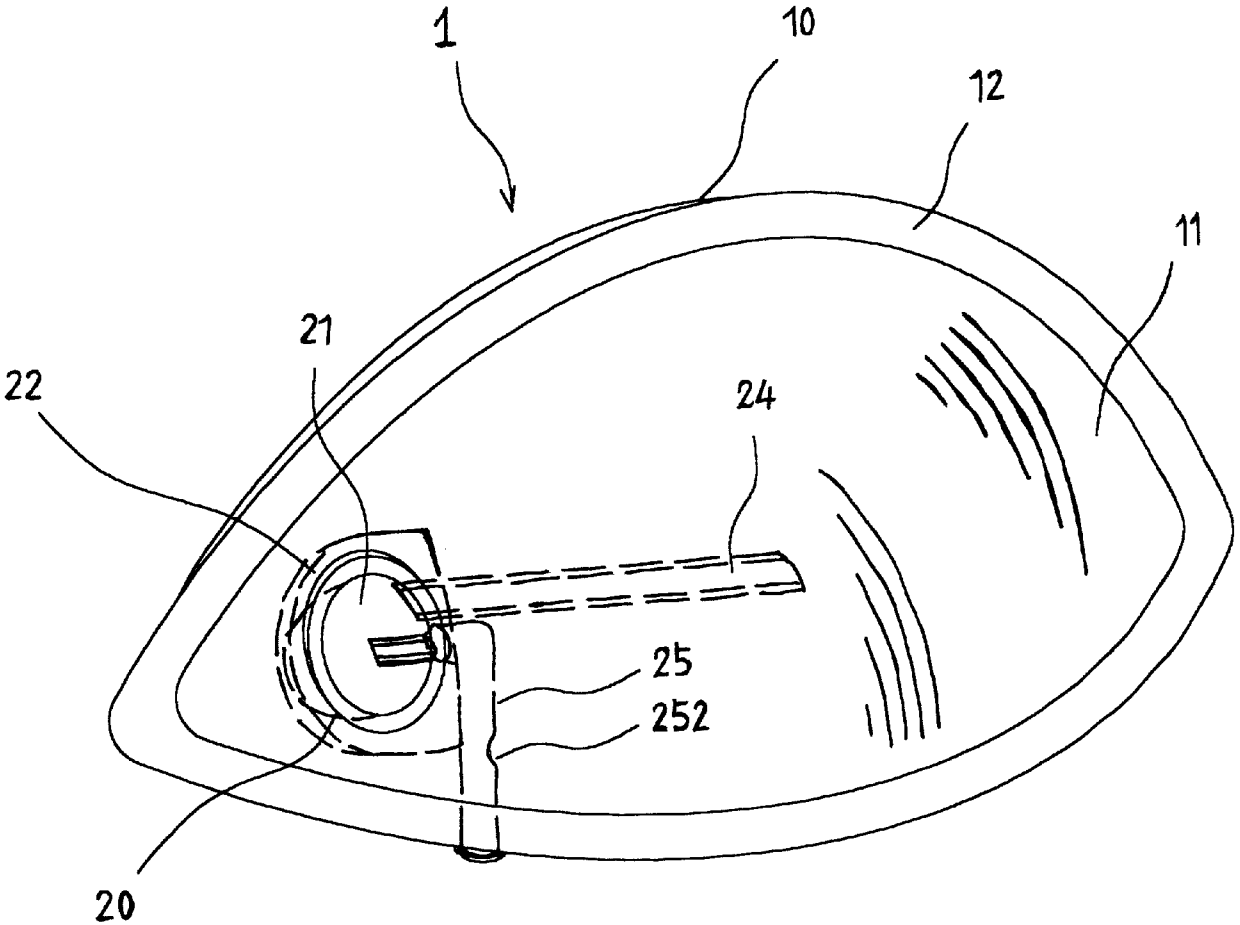
FIG. 3 is an illustration for structure of the inflation pad in the present invention.

Please refer to FIG. 3 for the structure 1 for the inflation pad with a built-in pump in the present invention, which mainly comprises an inflation unit 10 and an inflation pump assembly 20; wherein:

The inflation unit 10 uses air-impermeable tough film sealed at peripheral by high frequency process to form an inflation chamber 11 and laminated fringe 12;

The inflation pump assembly 20 is installed inside the inflation unit 10 and composed of composed of a protuberant pump chamber 22 and an inflation/deflation channel. The inflation pump is made of highly pressure resistant elastomer so it will not be contracted under pressure. Inside the pump chamber 22, there is a protuberant portion of pump 21. On one side of the pump chamber there are two pieces of unidirectional membrane tubing, A23 and B24, in a reverse loop. The membrane tubing B24 is provided as a channel between the pump chamber 22 and the inflation chamber 11. The membrane tubing A23 is installed inside the pump chamber 22 so that one end connects to the pump chamber 22 and the other end at the chamber edge connects to a piece of round tubing 25. On the proper place of the round tubing 25 surface, there is a vent hole 251. At the edge opening, there is an insertable hollow bolt 252, so a satisfactory inflation/deflation channel is formed.

Figure 4:
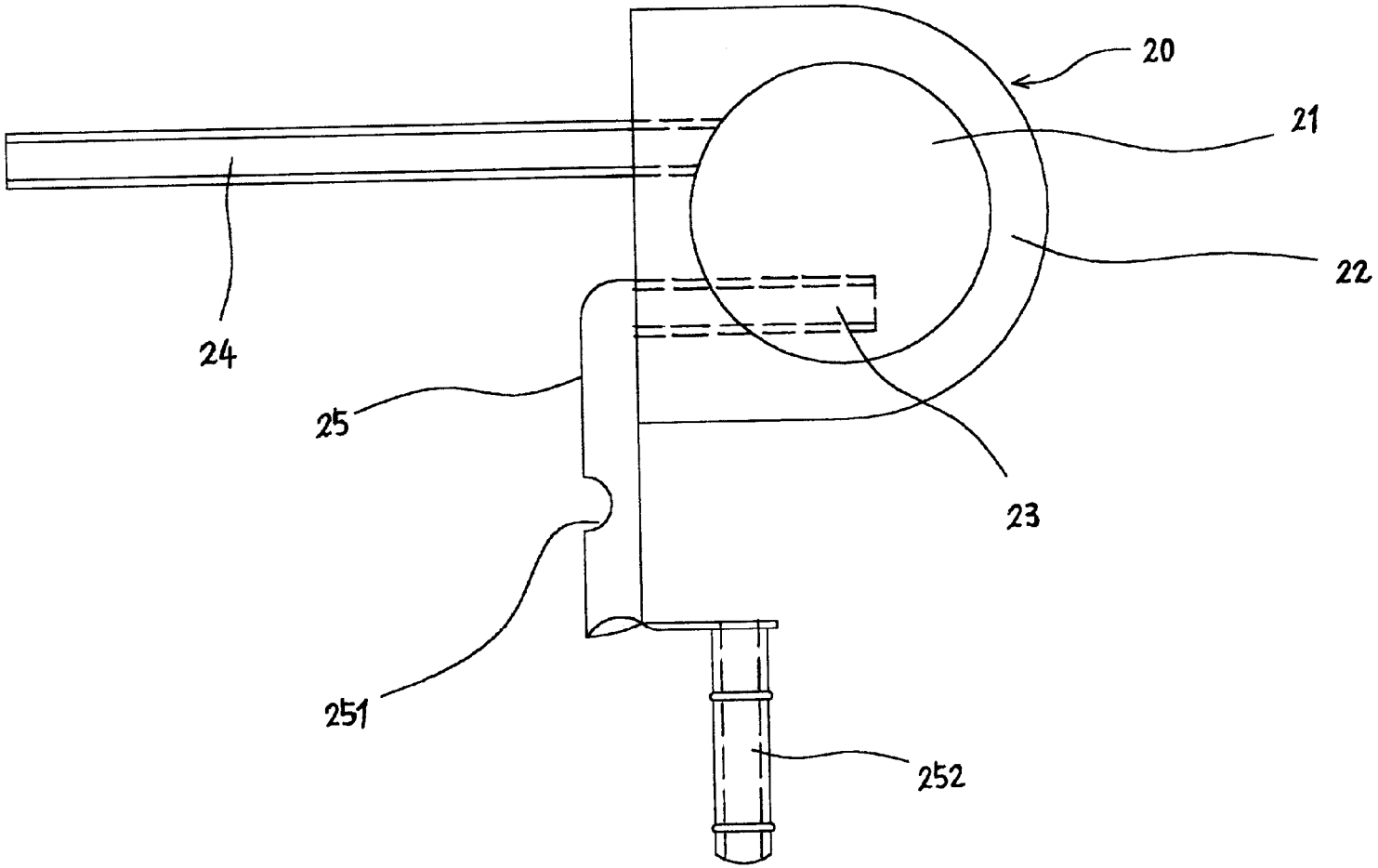
FIG. 4 is an illustration for structure of the inflation pump in the present invention.

The above description has exclusively covered the structure, characteristics and relative locations for all assembled components for the present invention. It is hoped that the patent examiners have gained certain understanding of the present invention. To further manifest the objectives, characteristics and performance for the present invention, further explanation is given below regarding the use and expected performance:

Based on the above-mentioned structure 1, in practical applications the inflation pads can be combined with other products like bras, pillows and shoes to add values to the products. Please refer to FIG. 4. When used for bras, the inflation pad structure 1 is placed inside the bra cup so that the users can feel more confident in their appearance.

Figure 5:
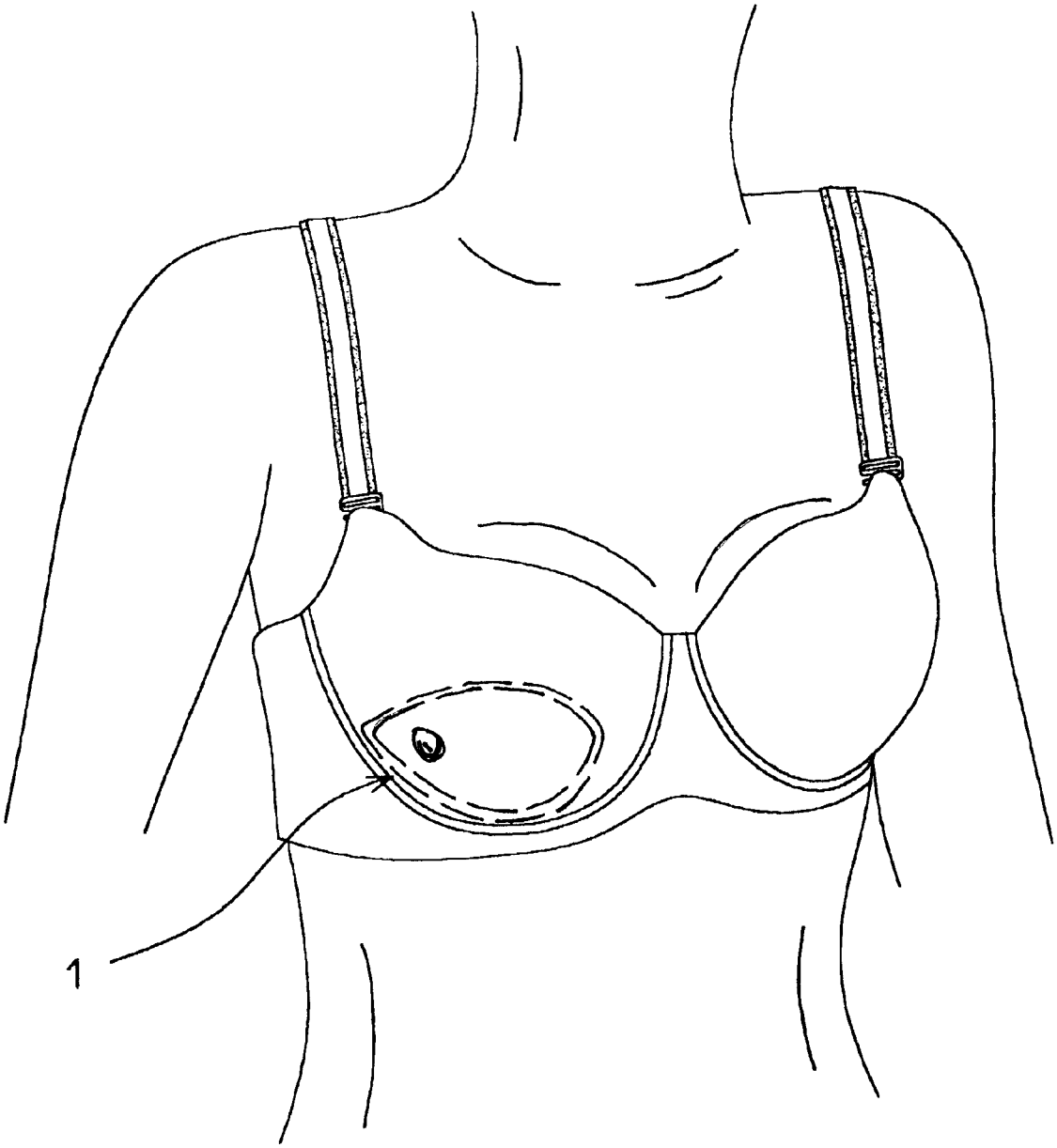
FIG. 5 is an illustration for an embodiment of an inflation pad in the present invention.
Figure 6:
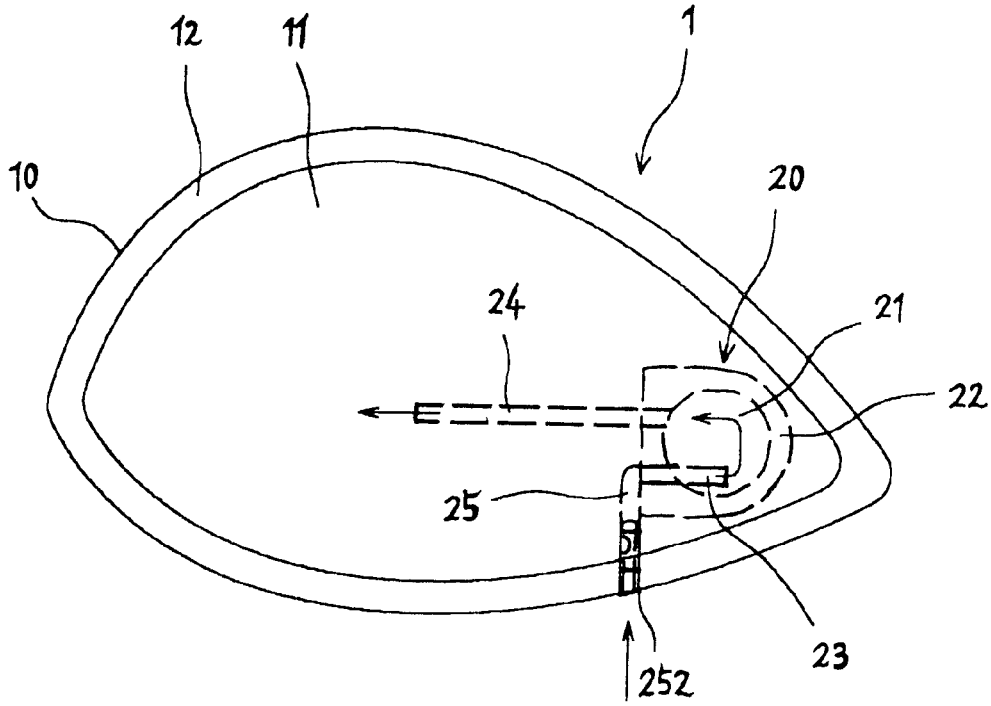
FIGS. 6A and 6B are illustrations for inflation and deflation actions for the present invention.
Figure 6:
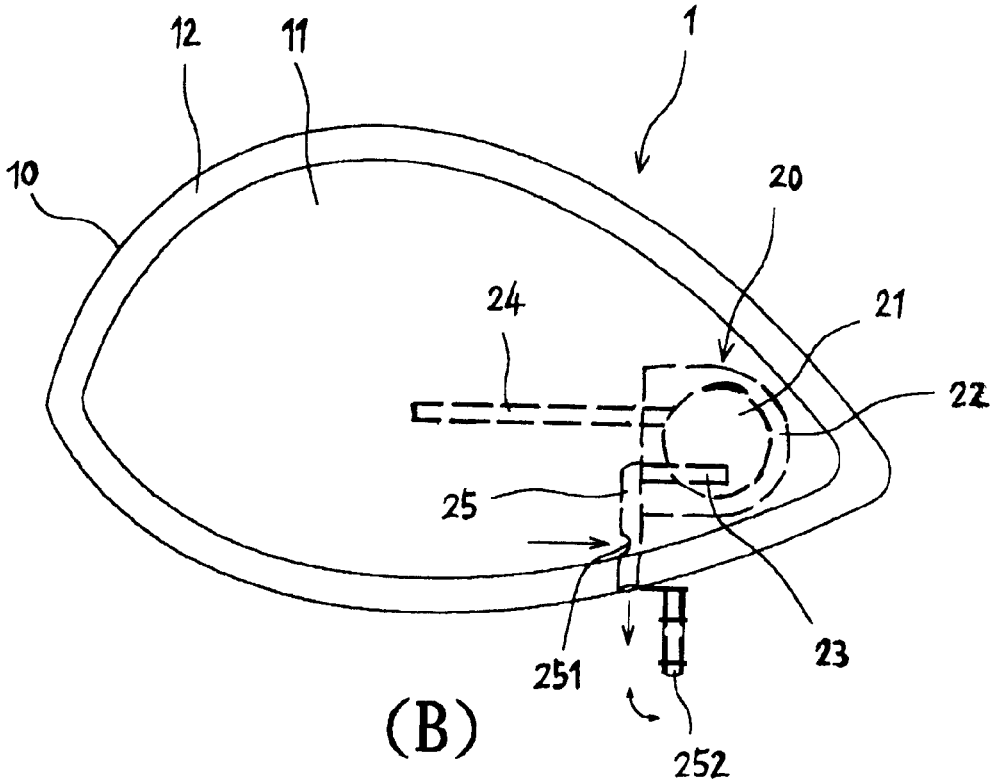

Again, please refer to FIGS. 5A and 5B. They are related to the operation principle for the inflation valve 1 in the present invention. As disclosed in FIG. 5A, the hollow bolt 252 is inserted into the round tubing 25 to seal the vent hole 251 and prevent leaking. Then, the user directly presses the protuberant portion 21 of pump by hand. Thus, the air inside the protuberant portion 21 is compressed and delivered through the unidirectional flat membrane tubing 24 to the inflation chamber 11. When the user releases the protuberant portion 21 off hand, due to negative pressure inside that portion 21 (pressure inside less than outside of the pad) the outside air is sucked into the pump chamber 22 through the round tubing 25 and the flat membrane tubing A23, through which cycle the inflation chamber 11 is filled with air to the desired inflation level.

For deflating the chamber 11, the user removes the hollow bolt 252 from the round tubing 25 and leaves the vent hole 251 open. Thus, the user can simply press the inflation chamber 11 to let the air inside leave through the vent hole 251.

Since the present invention adopts special unidirectional flat membrane tubing A and B23, 24, the air is only delivered to the inflation chamber 11 without reversed air flow when the protuberant portion 21 is pressed during the operation. Therefore, the inflation chamber 11 is efficiently and effectively filled with air to the desired inflation level. Great convenience and applicability are provided by the present invention.

Furthermore, the present invention can also be utilized in a way that the inflation pad unit 1 is covered with a piece of soft cloth to improve the hand touch and minimize the noise from compressed inflation chamber 11 during inflation/deflation.

It is worth to mention that the innovative thinking to combine a small air pump with an inflation pad from the inventor of the present invention can prevent concerns about estheticism and hygiene for mouth blowing for the traditional pads and also reduce the troubles and inconvenience from using auxiliary inflation equipment. On the other hand, the proper arrangement of the inflation/deflation access inside the inflation pad forms an integral channel structure, which allows easier and faster adjustment for inflation level. Moreover, the greatest feature for the present invention is the complete inflation/deflation access inside the inflation pad. Especially, a simple hollow bolt can solve the operational difficulty in inflation/deflation for traditional pads. Such inflation pad structure provides not only a basic function for inflation level control but also fast inflation/deflation, so it significantly improves the applicability and industrial value.

In general, the present invention discloses an inflation pad structure with a built-in pump that has the above-mentioned operational convenience for inflation and efficiency and effectiveness for inflation level control. Since no such structure design has ever been found before, the present invention is expected to meet the requirements for innovation patents and filed for patent application accordingly.

What is claimed is:

1. An inflation pad structure with a built-in pump, comprising an inflation unit and a pump assembly, whereas said inflation unit having an inflation chamber with laminated fringe and said pump assembly installed inside said inflation unit in a configuration of a protuberant pump chamber and an inflation/deflation access characterized in that:

inside said pump chamber, there is an elastic protuberant portion, on the edge of said pump chamber, there are two pieces of unidirectional membrane tubing, A and B, in a reverse loop, said membrane tubing B is provided as a channel between said pump chamber and said inflation chamber, said membrane tubing A is installed inside said pump chamber so that one end connects to said pump chamber and other end at a chamber edge connects to a piece of round tubing, said round tubing connects to said laminated edge of said inflation chamber and has an insertable hollow bolt at an opening so that an inflation access is formed, on a proper place of said round tubing surface, there is a vent hole for deflation loop, when in use, said hollow bolt is placed or removed from said round tubing, so said vent holes are closed or open, with continuous pressing said the pump chamber by users, benefits of inflation volume control and fast inflation/deflation are provided.

2. The inflation pad with a built-in pump of claim 1, wherein said inflation unit is covered with a piece of soft cloth.

* * * * *